US007768374B2

(12) United States Patent
Fushimi

(10) Patent No.: US 7,768,374 B2
(45) Date of Patent: Aug. 3, 2010

(54) INVERTER TRANSFORMER AND DISCHARGE TUBE DRIVE CIRCUIT USING THE SAME

(75) Inventor: Tadayuki Fushimi, Tokyo (JP)

(73) Assignee: Sumida Corporation, Tokyo (JP)

( * ) Notice: Subject to any disclaimer, the term of this patent is extended or adjusted under 35 U.S.C. 154(b) by 510 days.

(21) Appl. No.: 11/761,469

(22) Filed: Jun. 12, 2007

(65) Prior Publication Data

US 2007/0296535 A1 Dec. 27, 2007

(30) Foreign Application Priority Data

Jun. 26, 2006 (JP) ..... 2006-175639

(51) Int. Cl.
*H01F 27/28* (2006.01)
*H01B 41/24* (2006.01)

(52) U.S. Cl. ..... 336/216; 315/276

(58) Field of Classification Search ..... 315/277, 315/278, 279, 281; 336/198, 199, 221, 225, 336/229, 212–216, 208
See application file for complete search history.

(56) References Cited

U.S. PATENT DOCUMENTS 2,265,700 A 12/1941 Outt
5,847,518 A * 12/1998 Ishiwaki ..... 315/276
2005/0270133 A1* 12/2005 Chan et al. ..... 336/83
2005/0280492 A1* 12/2005 Kohno ..... 336/208
2006/0290453 A1* 12/2006 Park et al. ..... 336/83

FOREIGN PATENT DOCUMENTS

| | | |
|---|---|---|
| EP | 1 542 347 | 6/2005 |
| EP | 1 632 964 | 3/2006 |
| EP | 1 725 083 | 11/2006 |
| GB | 2 042 277 | 9/1980 |
| JP | 55102211 A | 8/1980 |
| JP | 64-030463 | 2/1989 |
| JP | 2000-133531 | 5/2000 |
| JP | 2003-031383 | 1/2003 |
| JP | 2004-506294 | 2/2004 |
| JP | 2004-349293 | 9/2004 |
| JP | 2005276919 | 10/2005 |
| JP | 2005-311227 | 11/2005 |

* cited by examiner

*Primary Examiner*—Douglas W Owens
*Assistant Examiner*—Minh D A
(74) *Attorney, Agent, or Firm*—Coats & Bennett, P.L.L.C.

(57) ABSTRACT

An inverter transformer to which coils for a balance transformer are integrally assembled. The inverter transformer is employed in a drive circuit for evenly driving a plurality of discharge tubes, and includes a primary coil and a secondary coil. The present invention proposes the inverter transformer which performs reduction in the number of components and in the size thereof by providing a through-hole a portion of a magnetic core section made from magnetic material configuring the inverter transformer, and by providing coils for a balance transformer through the through-hole.

12 Claims, 4 Drawing Sheets

INVERTER TRANSFORMER AND DISCHARGE TUBE DRIVE CIRCUIT USING THE SAME

This application claims the benefit of Japanese Patent Application No. 2006-175639, filed Jun. 26, 2006, which is hereby incorporated by reference herein in its entirety.

BACKGROUND OF THE INVENTION

1. Field of the Invention

This invention relates to an inverter transformer to which a balance transformer is integrally assembled, and a discharge tube drive circuit using such inverter transformer.

2. Description of the Related Art

It is well-known technology in a cold cathode discharge tube drive circuit that a balance coil is connected to a low voltage side of a drive circuit or a balance coil is connected to a high voltage side to which a cold cathode discharge tube of the drive circuit is connected in order to control current flowing through a plurality of discharge tubes to be constant. In the cold cathode discharge tube, if their impedances fluctuate, the voltage applied across both electrodes of the cold cathode discharge tube also fluctuates. Accordingly, it is known that the current flowing through each of the cold cathode discharge tube changes depends on the impedance of each of the cold cathode discharge tubes. If the current flowing through the cold cathode discharge tube fluctuates, this effects light emission of the cold cathode discharge tubes.

As well-known, a plurality of cold cathode discharge tubes are provided in a backside of a LCD panel as back-light. As a recent trend, a display size of the LCD panel becomes larger. For example, a home-use LCD-TV have had 20 inches, however, recently, LCD-TV using LCD panel having display size of 32 or 34 inches becomes popular. As the size of the LCD panel becomes larger, the number of necessary discharge tubes per one LCD-TV also increases.

As described above, if each amount of current flowing through each of cold cathode discharge tubes is different from each other, unevenness of light emission among cold cathode discharge tubes, and this causes unevenness of luminance level in a LCD panel. Accordingly, it is positively necessary to adjust the amount of current flowing thorough each cold cathode discharge tubes to be constant. Therefore, normally, an inverter transformer and a balance transformer are employed in a drive circuit for cold cathode discharge tubes.

Conventionally, it is proposed to a method in which a balance coil is connected to a low voltage side or a high voltage side of a cold cathode discharge tube drive circuit. Further, it is also proposed to provide a plurality of corresponding coils in order to apply to a plurality of cold cathode discharge tubes with a single magnetic path of a balance transformer such as disclosed in Japanese Patent Laid-open 2003-31383. In addition, it is proposed a circuit in Published Japanese translation of PCT International Publication for patent application 2004-506294 wherein first inductor connected to primary coil of a first transformer and second inductor connected to primary coil of second transformer are provided in the same magnetic path. Further, there is provided an inverter transformer configuring with 1, H, and I cores in Japanese Patent Laid-open 2005-311227. In addition, there are also provided a transformer in which a main transformer and a signal transmission transformer are integrally assembled and a transformer in which a choke coil and a transformer are integrally assembled as disclosed in Japanese Patent Laid-open 2004-349293, 64-030463, and 2000-133531.

SUMMARY OF THE INVENTION

However, normally, it is usual that each of an inverter transformer and a balance transformer is formed as an individual transformer, and then they are assembled to an unit. Namely, an inverter transformer, a balance transformer, a switching circuit and a control circuit are assembled on a circuit board to set up a cold cathode discharge tube drive circuit. However, if an inverter transformer and a balance transformer are assembled separately, it requires not only more space but also more costs for components and fabrication. Further, it becomes difficult for cold cathode discharge tube drive circuit to be small, and also it becomes difficult to satisfy a requirement from a LCD panel side with regard to reduction in size and weight.

Further, there is proposed a transformer in which a main transformer and a signal transmission transformer are integrally assembled, or a transformer in which a choke coil and a transformer are integrally assembled. However, it is necessary to use another core in order to avoid magnetic interference between the main transformer and the signal transmission transformer or between the choke coil and the transformer, and this increases the costs.

The present invention proposes an inverter transformer in which coils for balance transformer are integrally assembled within the inverter transformer to achieve low cost.

The present invention proposes an inverter transformer having core section made of magnetic material, and primary and secondary coils provided on the core section, and comprises: a through-hole at the core section; and additional coils wound through the through-hole.

The present invention further proposes an inverter transformer having a core section made of magnetic material for magnetically coupling a primary coil and a secondary coil, comprises: a through-hole formed at an end portion of the core section; and coils for a balance transformer wound through the through-hole.

The present invention further proposes a discharge tube drive circuit that uses the inverter transformer of the above embodiment.

According to the present invention, it is possible to provide an inverter transformer that has less components, and is able to achieve downsizing. In addition, it is also possible to provide an inexpensive balance transformer integrated inverter transformer in which a through-hole is provided at a core and a coil for the balance transformer is wound through the through-hole.

Further features of the present invention will become apparent from the following description of exemplary embodiments with reference to the attached drawings.

DESCRIPTION OF THE EMBODIMENTS

Embodiment 1

Figure 1A:
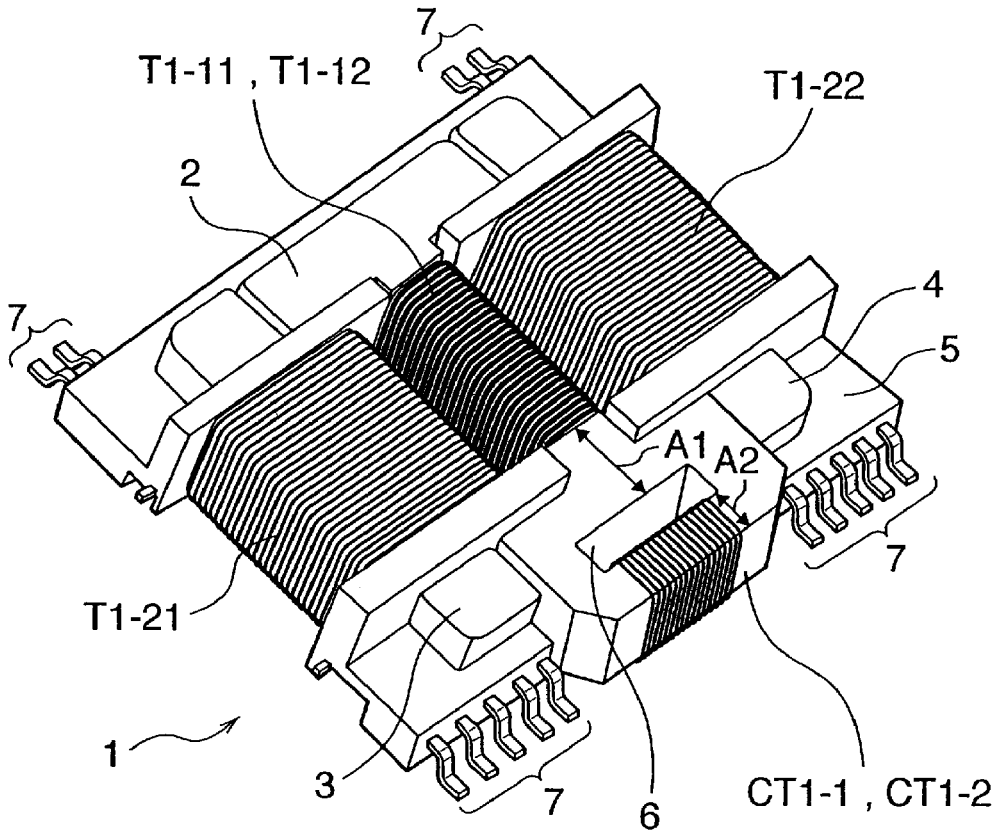
FIGS. 1A and 1B are views designating configurations of an inverter transformer according to a first embodiment of the present invention.
Figure 1B:
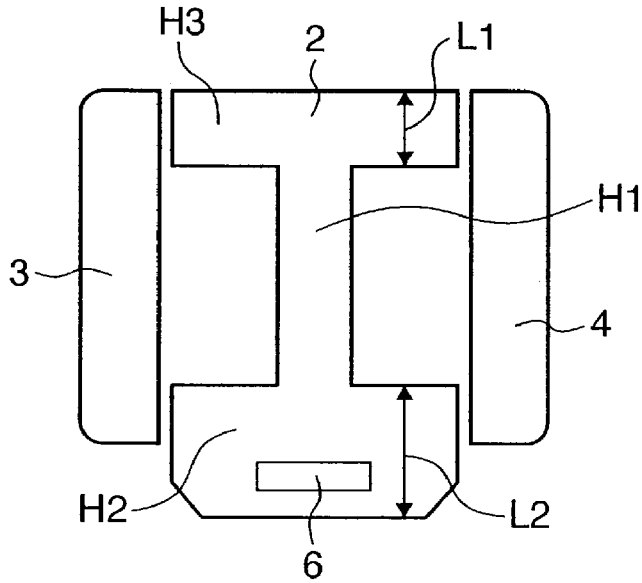

FIG. 1A shows an external perspective view of an inverter transformer 1 according to a first embodiment of the present invention. FIG. 1B shows only a core section of the inverter transformer 1 in FIG. 1A. In FIGS. 1A and 1B, the inverter transformer 1 is configured with an H-shaped core 2, I-shaped cores 3 and 4, and a bobbin 5 to be wound coil. The H-shaped core 2 and the I-shaped cores 3 and 4 are assembled with the bobbin 5. These cores 2, 3 and 4 are made from magnetic material. Further, the bobbin 5 is made from an insulating material having electric and magnetic insulating characteristics.

Primary coils T1-11 and T1-12 for the inverter transformer 1 are wound on a center core portion H1 of the H-shaped core 2, and secondary coils T1-21 and T1-22 for the inverter transformer 1 are respectively wound on the I-shaped cores 3 and 4. In addition, there is provided a through-hole 6 at one side core portion H2 of the side core portions H2 and H3 in the H-shaped core 2, and as shown in FIG. 1A, primary and secondary coils CT1-1 and CT1-2 for a balance transformer are wound through the through-hole 6. Reference 7 designates a terminal group divided into a plurality of terminals, and they are connected to respective end of the coils for the inverter transformer and the balance transformer for external wirings.

As described above, it becomes possible to present an inverter transformer achieving reduction of weight, size and fabrication costs by providing the through-hole 6 at a portion of the core section used in the inverter transformer 1, and by winding the coils CT1-1 and CT1-2 for the balance transformer.

A position of the through-hole 6 is set so that a magnetic flux generated by the primary coils T1-11 and T1-12 and the secondary coils T1-21 and T1-22 and flow through the H-shaped core 2 and a magnetic flux generated by the coils CT1-1 and CT1-2 for the balance transformer and flow through the H-shaped core do not interfere to each other.

For example, in FIG. 1A, if the relation between a length A1 and a length A2 is A1>A2, a fair amount of magnetic flux interferences can be suppressed. The inverter transformer according to the first embodiment of the present invention, it is able to achieve a downsized inverter transformer by integrating the coils for the balance transformer.

It is able to form the through-hole 6 by modification after the H-shaped core 2 is formed, or the through-hole 6 is formed simultaneously with the H-shaped core 2 using a mold for the H-shaped core 2 having a function to form the through-hole 6. In case of designing a size of the H-shaped core, it is preferable to design a size L2 of the core portion H2 on which the through-hole 6 is formed is longer than a size L1 of the core portion H3 on which the through-hole 6 is not formed. Thus formed balancer transformer is resultantly configured with quasi-toroidal core form by providing a through-hole at an end of a core portion made from magnetic material and on which coils for an inverter transformer are wound. Accordingly, costs of material are reduced, and the number of components is also reduced, so that it becomes possible to reduce the fabrication cost. Further, the inverter transformer of the invention becomes equivalent to such inverter transformer that is added a balance transformer with a toroidal core. Further, it is able to form a toroidal-shaped balance transformer so that a magnetic gap error and an assembling error do not occur, and only errors due to fluctuation of the material exist. Therefore, it becomes possible to fabricate an inverter transformer having less impedance fluctuation and high precision.

Figure 2:
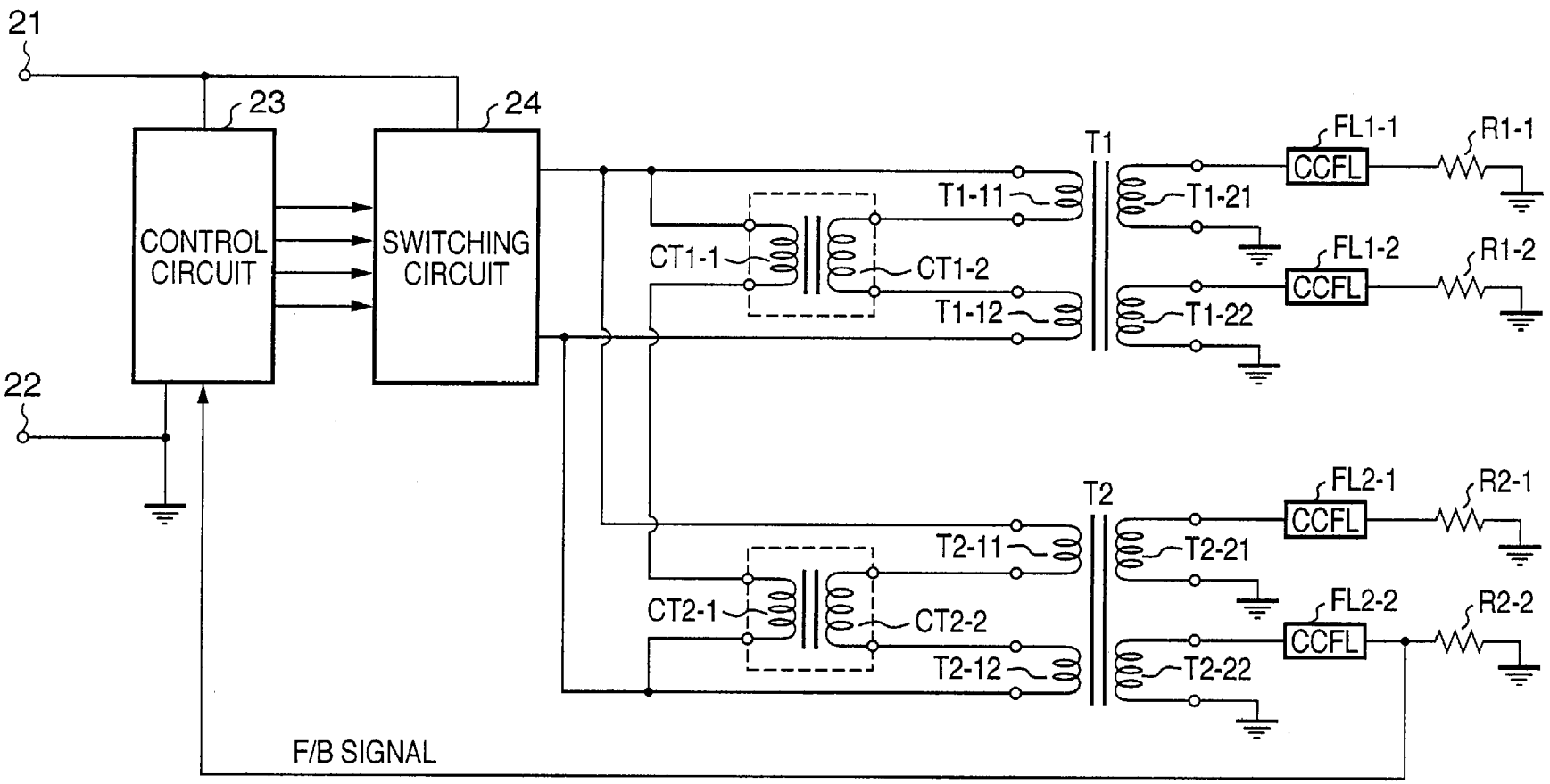
FIG. 2 is one example of a cold cathode discharge tube drive circuit to which the inverter transformer according to the first embodiment of the present invention is applied.

FIG. 2 shows one embodiment of a cold cathode discharge tube drive circuit to which the inverter transformer 1 shown in FIGS. 1A and 1B is applied.

A DC voltage is applied to power source terminals 21 and 22, and is supplied to a control circuit 23 and a switching circuit 24, respectively. In this case, the power source terminal 22 is connected to ground. The control circuit 23 includes an oscillator circuit or a PWM circuit inside, and a switching signal outputted there-from is modulated by a F/B signal that is described later. A switching circuit 24 includes a switch circuit configured with transistors, switches the DC voltage applied to the power source terminal 21 with the switching signal supplied from the control circuit 23, and outputs a pulse drive signals (drive voltage) generated by the switching. The cold cathode discharge tube drive circuit shown in FIG. 2 employs two inverter transformers illustrated in FIGS. 1A and 1B. Namely, each of inverter transformers T1 and T2 corresponds to the inverter transformer 1 in FIGS. 1*a* and 1B.

As shown in the figure, the primary coils CT1-1 and CT2-1 of the two balance transformers are connected in series, and at both ends of the series connection are applied with pulse drive signals (drive voltage) from the switching circuit 24.

The secondary coil CT1-2 for the balance transformer in the inverter transformer T1 is connected to the primary coils T1-11 and T1-12 in the inverter transformer T1 in series as shown in FIG. 2, and pulse drive signals are applied to both ends of the primary coils T1-11 and T1-12.

Further, the secondary coil CT2-2 for the balance transformer in the inverter transformer T2 is connected to the primary coils T2-11 and T2-12 in the inverter transformer T2 in series as shown in FIG. 2, and pulse drive signals are applied to both ends of the primary coils T2-11 and T2-12.

Further, one terminal of the secondary coil T1-21 in the inverter transformer T1 is connected to ground by way of a cold cathode discharge tube FL1-1 and a resister R1-1, and another terminal is connected directly to ground. Similarly, one terminal of the secondary coil T1-22 in the inverter transformer T1 is connected to ground by way of a cold cathode discharge tube FL1-2 and a resister R1-2, and another terminal is connected directly to ground.

Further, one terminal of the secondary coil T2-21 in the inverter transformer T2 is connected to ground by way of a cold cathode discharge tube FL2-1 and a resister R2-1, and another terminal is connected directly to ground. Similarly, one terminal of the secondary coil T2-22 in the inverter transformer T2 is connected to ground by way of a cold cathode discharge tube FL2-2 and a resister R2-2, and another terminal is connected directly to ground. Further, a connecting mid-point of the cold cathode discharge tube FL2-2 and the resister R2-2 is derived and supplied to the control circuit 23 as the F/B signal for controlling the current flowing through the cold cathode discharge tube FL2-2.

In the cold cathode discharge tube drive circuit using the inverter transformers T1 and T2 of the present invention such as shown in FIG. 2, the switching signal is modulated in accordance with an oscillation frequency of the oscillation circuit or a pulse width modulation by the PWM circuit included in the control circuit 23 by feeding back the F/B signal to the control circuit 23. Thereby, the current flowing through the cold cathode discharge tube FL2-2 is controlled to be constant and emission brightness thereof becomes constant. Further by providing coils for the balance transformer, the currents flowing through the inverter transformers T1 and T2 are controlled to be equal, and it becomes possible to have all cold cathode discharge tubes FL1-1 to FL2-2 emit evenly, The inverter transformers T1 and T2 to be used in the cold cathode discharge tube drive circuit as shown in FIG. 2 employ such inverter transformer that uses two primary coils, two secondary coils and coils for balance transformer. However, a configuration of the inverter transformer, a relation between the inverter transformer and the discharge tubes, and a connecting relation to the coils for the balance transformer are not limited to those described above, and may be modified in a wide variety.

Embodiments 2 to 5

Figure 3A:
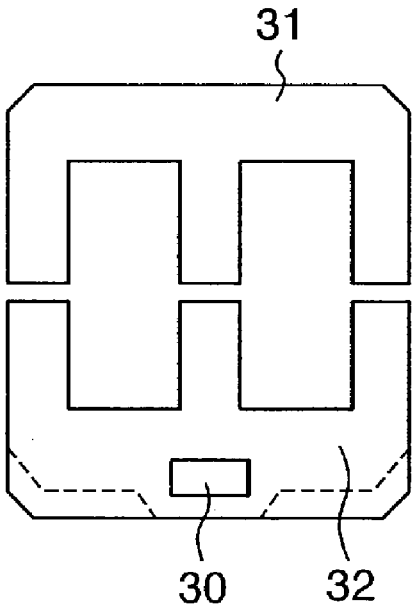
FIGS. 3A-3D are views of configurations of cores in the inverter transformers according to the second to fifth embodiments of the present invention.

FIGS. 3A to 3D show configurations of core sections according to second to fifth embodiments of the present invention. The inverter transformer according to second embodiment uses two E-shaped cores 31 and 32 as shown in FIG. 3A. In this case, a through-hole 30 for coils for balance transformer is provided at the E-shaped core 32.

Figure 3B:
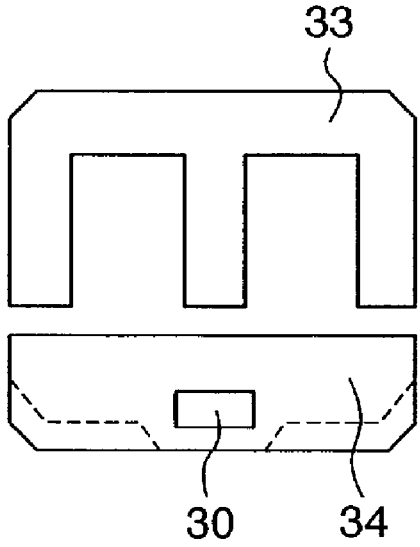

Further, the inverter transformer according to third embodiment uses one I-shaped core 33 and one E-shaped core 34 as shown in FIG. 3B. In this case, the through-hole 30 for coils of balance transformer is provided at the I-shaped core 34.

Figure 3C:
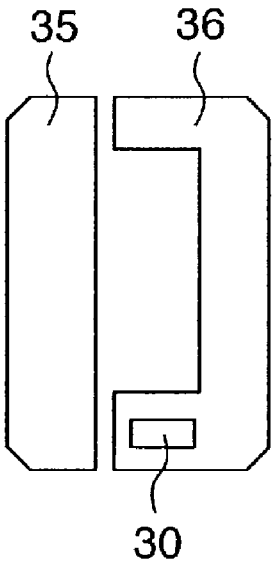

Still further, the inverter transformer according to fourth embodiment uses one I-shaped core 35 and one U-shaped core 36 as shown in FIG. 3C. In this case, the through-hole 30 for coils of balance transformer is provided at the U-shaped core 36.

Figure 3D:
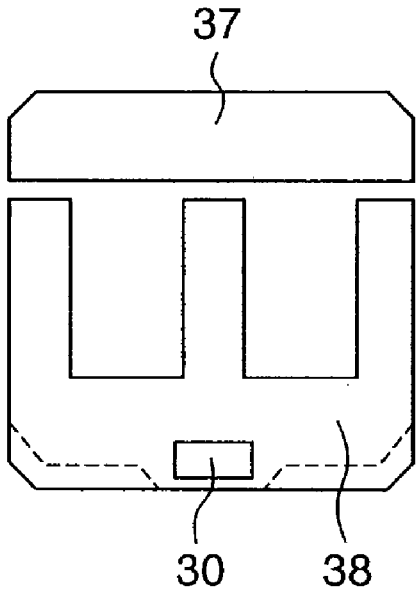

In addition, the inverter transformer according to fifth embodiment uses one I-shaped core 37 and one E-shaped core 38 as shown in FIG. 3D. In this case, the through-hole 30 for coils of balance transformer is provided at the E-shaped core 38.

The above-mentioned embodiments 2 to 5 only show some of embodiments of the present invention, and it is possible to modify these embodiments with a similar manner.

In any of above mentioned embodiments shown in FIG. 3A to 3D, the position of the through-hole 30 is also set so that a magnetic flux generated by the primary coils T1-11 and T1-12 and the secondary coils T1-21 and T1-22 in the inverter transformer 1 and a magnetic flux generated by the coils CT1-1 and CT1-2 of the balance transformer do not interfere to each other. Accordingly, a core section where a through-hole is provided is made wider. In any of the embodiments, an entire core section where a through-hole is provided is made wider, however, it may be made wider only a portion where a through-hole is provided. For example, it is possible to reduce the amount of use of the core material by configuring the core portions as shown in FIGS. 3A, 3B, and 3D.

Embodiment 6

Figure 4:
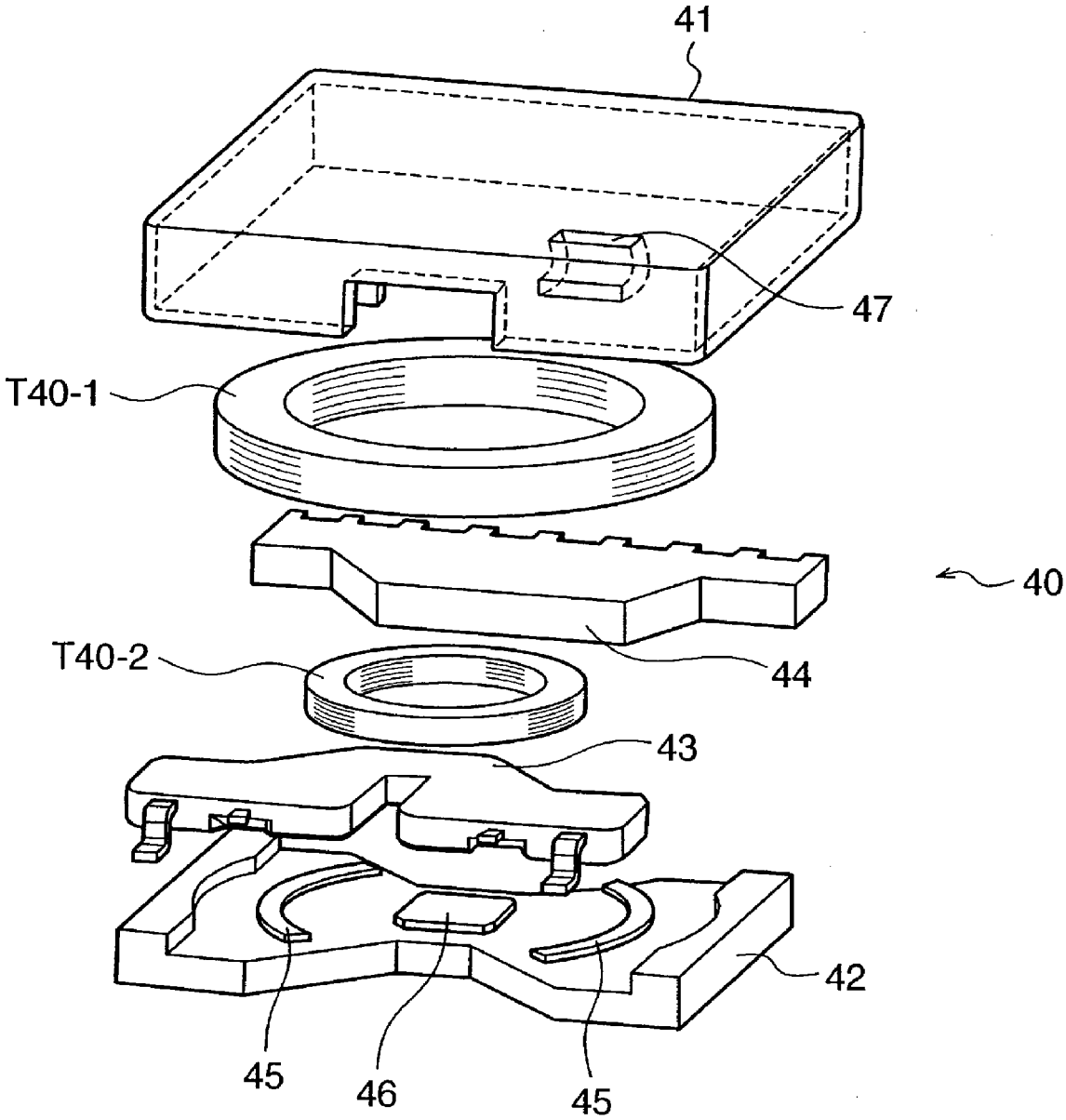
FIG. 4 is an exploded perspective view of the inverter transformer according to sixth embodiment of the present invention.

FIG. 4 is a perspective view showing one example of an inverter transformer assembled in a box shape according to sixth embodiment of the present invention. In this FIG. 4, an inverter transformer 40 uses both a lid section 41 and a base section 42 being made from magnetic material. In addition, there are provided a primary coil T40-1 and a secondary coil T40-2 for the inverter transformer 40. The secondary coil T40-2 is fit inside of the primary coil T40-1 when assembled.

In this case, an inner surface of the primary coil T40-1 is positioned by an outer surface of an arc-shaped guide 45, and an outer surface of the secondary coil T40-2 is positioned by an inner surface of the arc-shaped guide 45, respectively. Reference 40 is a mid-leg portion penetrating through the both coils T40-1 and T40-2. In this case, references 43 and 44 are auxiliary base section for extracting terminals and after being assembled, these are configured to be fit on both side portions of the base section 42. In this sixth embodiment, a through-hole 47 is provided at a corner of the lid section 41 for the coils of the balance transformer In this sixth embodiment, a position of the through-hole 47 is also set so that a magnetic flux generated by the primary coils and the secondary coils and flow through the H-shaped core 2 and a magnetic flux generated by the coils of the balance transformer and flow through the H-shaped core do not interfere to each other. Accordingly, it is also possible to provide the through-hole 47 at any position of the lid section 41 or base section 42, if the fluxes do not interfere to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An inverter transformer having a core section made of magnetic material, and primary coils and secondary coils provided on said core section, comprising:

a through-hole provided on the core section;

at least two coils which are different from the primary and secondary coils; the at least two coils wound through the through-hole;

wherein the through-hole is positioned such that magnetic flux generated by the at least two coils does not interfere with magnetic flux generated by primary and secondary coils.

2. The inverter transformer according to claim 1 wherein said at least two coils configure a balance transformer.

3. The inverter transformer according to claim 1 wherein the through-hole is positioned apart from the primary coils and the secondary coils.

4. The inverter transformer according to claim 1 wherein:

the core section is configured with an H-shaped core and two I-shaped cores;

said primary coils are wound on the H-shaped core, and said secondary coils are wound on the two I-shaped cores.

5. The inverter transformer according to claim 4 wherein:

the H-shaped core has two flanges of unequal size;

the through-hole is provided on the larger of the two flanges.

6. The inverter transformer of claim 1:

wherein the core section is configured with a plurality of cores;

wherein a core of the plurality of cores has first and second end portions disposed on respective ends of the core section;

wherein the first end portion has a length in a direction along an axis of the core portion longer than a length in the same direction of the second end portion;

wherein the through-hole is formed in the first end portion.

7. An inverter transformer assembly, comprising:

a core section configured with magnetic material for magnetically coupling primary coils and secondary coils forming an inverter transformer;

a through-hole formed at an end portion of the core section;

a primary coil and secondary coils for a balance transformer which are different from the primary and secondary coils of the inverter transformer and are wound through the through-hole;

wherein magnetic flux generated by the inverter transformer and magnetic flux generated by the balance transformer do not interfere with each other.

8. The inverter transformer assembly according to claim 7 wherein the through-hole is spaced along core section from the primary and secondary coils of the inverter transformer.

9. The inverter transformer according to claim 7 wherein:

the core section is configured with an H-shaped core, and two I-shaped cores;

said primary coils of the inverter transformer are wound on the H-shaped core, and said secondary coils of the inverter transformer are wound on the two I-shaped cores, respectively.

10. The inverter transformer according to claim 9 wherein:

the H-shaped core has two flanges of unequal length;

the through-hole is provided on a longer of the two flanges.

11. A discharge tube drive circuit comprising:

at least two inverter transformers each according to claim 7;

a switching circuit for supplying switching pulses to the at least two inverter transformers;

wherein primary coils of each of the at least two inverter transformers and a secondary coil of each of the balance transformers are connected in series and connected to the switching circuit;

wherein primary coils of the balance transformers are connected in series and connected to the switching circuit.

12. The inverter transformer according to claim 7 wherein the end portion at which the through-hole is formed has a length in a direction along an axis of the core section that is longer than a length in the same direction of an opposing end portion.

* * * * *